US007112049B2

(12) United States Patent
Fueller et al.

(10) Patent No.: US 7,112,049 B2
(45) Date of Patent: Sep. 26, 2006

(54) DEEP-DRAWING TOOL

(75) Inventors: Karl-Heinz Fueller, Neu-Ulm (DE); Tilmann Haug, Weissenhorn (DE); Dirk Hortig, Hattenhofen (DE); Michael Knueppel, Ulm (DE)

(73) Assignee: DaimlerChrysler Ag, Stuttgart (DE)

( * ) Notice: Subject to any disclaimer, the term of this patent is extended or adjusted under 35 U.S.C. 154(b) by 79 days.

(21) Appl. No.: 10/755,239

(22) Filed: Jan. 12, 2004

(65) Prior Publication Data

US 2005/0084557 A1 Apr. 21, 2005

(30) Foreign Application Priority Data

Jan. 10, 2003 (DE) ..... 103 00 630

(51) Int. Cl.
*B21D 37/00* (2006.01)
*B29C 43/58* (2006.01)

(52) U.S. Cl. ..... 425/149; 425/170; 425/385; 425/403; 425/469

(58) Field of Classification Search ..... 425/149, 425/170, 385, 403, 408, 469, DIG. 44; 72/347, 72/350

See application file for complete search history.

(56) References Cited

U.S. PATENT DOCUMENTS 4,796,460 A 1/1989 Smedberg
5,174,933 A * 12/1992 Toh et al. ..... 425/149
5,528,918 A * 6/1996 Kirii ..... 72/350
5,542,835 A * 8/1996 Kennedy et al. ..... 425/154
5,622,069 A * 4/1997 Walters
5,735,201 A * 4/1998 Hirao et al. ..... 100/269.01

FOREIGN PATENT DOCUMENTS

| | | |
|---|---|---|
| DE | 199 25 458 A | 12/2000 |
| EP | 0 312 808 A | 4/1989 |
| EP | 0 626 223 A | 11/1994 |
| EP | 0 699 899 B | 3/1996 |
| EP | 0 740 968 A | 11/1996 |
| JP | 112 26 794 A | 8/1999 |

* cited by examiner

*Primary Examiner*—Duane Smith
*Assistant Examiner*—Thu Khanh T. Nguyen
(74) *Attorney, Agent, or Firm*—Akerman Senterfitt; Stephan A. Pendorf

(57) ABSTRACT

The invention is concerned with a compression molding device (1) with a tool (3) generating at least a part of the work-piece geometry. At least one pressure measuring means (5) and/or at least one pressure space (4) is located directly below the work-piece associated surface (3.3) of the tool (3). Besides this, the work piece (3) selectively exhibits at least one first part (3.1) which is a tool template generating the shape of the work piece and a second part (3.2) forming the base body, wherein a measuring strip (6) is provided between the tool template (3.1) and the base body (3.2). As an optional refinement, the measuring strip (6) is an elastic intermediate layer with a smaller modulus of elasticity than the base body (3.2).

11 Claims, 1 Drawing Sheet

DEEP-DRAWING TOOL

BACKGROUND OF THE INVENTION

1. Field of the Invention

The invention is concerned with a molding device (compression molding, press forming) with at least one punch for generating at least a part of the work piece geometry, which is associated with a mold (bottom die, master negative) corresponding to at least a part of the work piece geometry. Such a device is already known from DE 199 25 458 A1.

2. Description of the Related Art

A process for high pressure forming of sheet metal parts is known from DE 44 17 460 A1. For the process a device is employed with an intermediate plate for receiving the sheet metal parts to be formed, with draw-rings lying form-fittingly against both sides of the intermediate plate. The draw-rings serve to fix and seal the sheet metal parts to the intermediate plate. The shaping space formed by the draw rings is bordered in the direction of the face by a die, which is flexible, in order to positively influence the forming or shaping process.

DE 693 31 016 T2 discloses a device is known for measurement of the holding or retention force exercised upon the pressure ring of a press. The device is provided prior to the insertion of the punching die and the pressure elements, in order to determine the retention force to be applied later.

DE 198 55 407 A1 discloses a shaping tool comprised of a two-layer composite. The second layer is formed of metal and applied electrolytically upon a plastic carrier structure.

SUMMARY OF THE INVENTION

The present invention is concerned with the task of designing and arranging a shaping tool in such a manner that the process stability and the process reliability are optimized.

This task is solved in accordance the invention thereby, that the punch and/or the mold or die plate include at least one pressure measuring means directly in the area of the surface associated with the work piece, and/or at least one actuator in the form of a hydraulic pocket below the surface. Thereby it is achieved that the stress or tension distribution is not influenced by a tool intrinsic bending line or deflection line or elastic curve. The desired tension distribution is applied over the surface and measured by the pressure measurement means or, as the case may be, optimized by the actuators.

For this it is advantageous that the pressure measuring means and/or the actuator in the form of a hydraulic pocket or as a pressure space is oriented relative to the surface, and the distance between the pressure space and the surface is between 0.5 mm and 3 mm, particularly preferably 1 mm. Therewith the bending line of the tool which negatively influences the shaping process can be compensated by changing the pressure in the hydraulic pocket. The alignment or arrangement of the hydraulic pockets relative to the surface optimizes or benefits a compensation movement.

A further possibility, in accordance with a further embodiment, is that the pressure measuring means is a piezo sensor and/or a measuring strip, provided flush with or, as the case may be, at the height of the surface or directly below the surface, wherein multiple pressure measuring means and/or pressure spaces are distributed relative to the surface. Therewith local pressure conditions, wrinkles or fold formations and/or thinning of the sheet metal can be measured during shaping or, as the case may be, in situ, and adjusted or compensated by the actuators or, as the case may be, further process parameters. A marking process for breaking-in or working-in of the tool parts is no longer necessary.

The inventive task is further solved thereby, that the tool and/or the punch is comprised of at least a first part and a second part, the first part in the form of a tool punch forming the shape of the work piece and the second part being the base body receiving the tool punch, wherein between the tool punch and the base body an active intermediate layer is provided for measuring the contact stress and for diffusing local tension peaks. The intermediate layer makes possible a dynamic measurement of the contact stresses during forming and the contact relationship between the tool and the work piece are not distorted. The tool template thereby exhibits a thickness of between 0.5 mm and 4 mm, preferably between 1 mm and 2 mm.

According to a preferred embodiment of the inventive solution it is further provided that the tool template is connected releaseably with the base body and/or with the intermediate layer and selectively provided or positioned on the intermediate layer or on the base body. The tool template can therewith be provided directly upon the base body without the intermediate layer. The intermediate layer is replaceable or exchangeable. It is also envisioned that multiple intermediate layers can be provided, which have different tasks, such as the measurement of the contact stresses and/or the diffusion or removal of local tension peaks.

It is of particular significance for the present invention that the intermediate layer is provided as measurement strip or sheet with at least one sensor and/or as elastic intermediate layer, wherein the sensor is a dye sensor and/or a piezo element. IN accordance with the conditions of the shaping process a suitable intermediate layer can be employed.

It is further preferred that the base body exhibits a greater E-modulus (modulus of elasticity) than the elastic intermediate layer. Therewith the elasticity is defined by the intermediate layer. The various materials for the base body and the intermediate layer are freely widely selectable.

Besides this, it is advantageous when the intermediate layer is formed of plastic and the tool template is formed of wear or abrasion resistant material. The tool template is substantially stiffer, since the wear resistance and the shape precision must be ensured or guaranteed.

BRIEF DESCRIPTION OF THE DRAWINGS

Further advantages and details of the invention are set forth in the patent claims and in the description and represented in the figures.

In the figures there is shown.

DETAILED DESCRIPTION OF THE INVENTION

Figure 1:
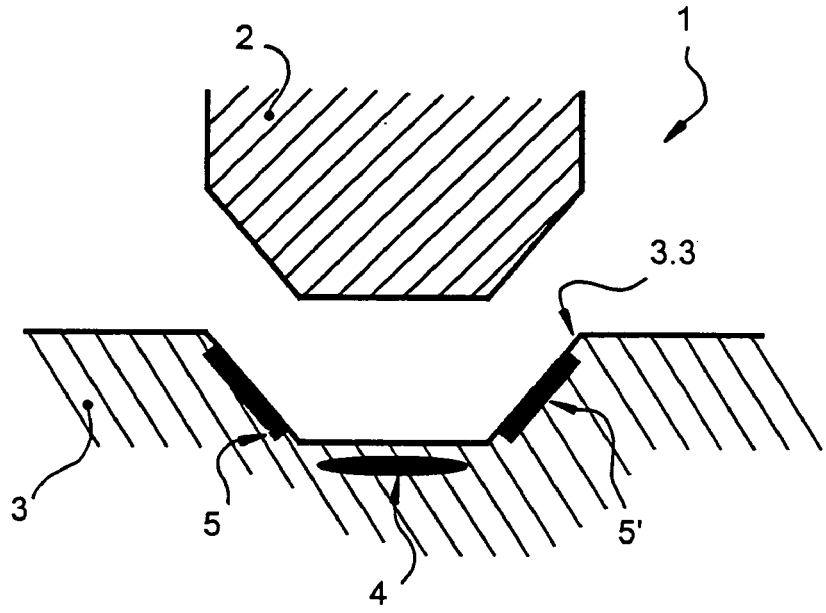
FIG. 1 a forming device with punch, mold and pressure receiving part.

The forming device 1 according to FIG. 1 is comprised of a punch 2 as well as a mold (bottom die, master negative) 3. The punch 2 and the mold 3 exhibit the same surface shapes, which bring about the deep drawing of a not shown component.

The mold 3 or, as the case may be, the mold body, includes directly in the area of the surface 3.3 of the mold 3 various actuators 4 or pressure measuring means 5 in the form of pressure spaces or, as the case may be, hydraulic pockets.

On the two slanted surfaces there is respectively provided a pressure measuring part 5, 5' oriented along the surface 3.3, directly below the surface 3.3 or, as the case may be, at the level of the surface 3.3. The pressure measuring part 5, 5' is therein provided within a not shown recess and is there cast in place.

In the middle, central area a hydraulic pocket 4 is provided below the surface 3.3. Both the pressure measuring part 5, 5' as well as the hydraulic pocket 4 are in communication with a not shown process control device via not shown connecting elements.

Figure 2:
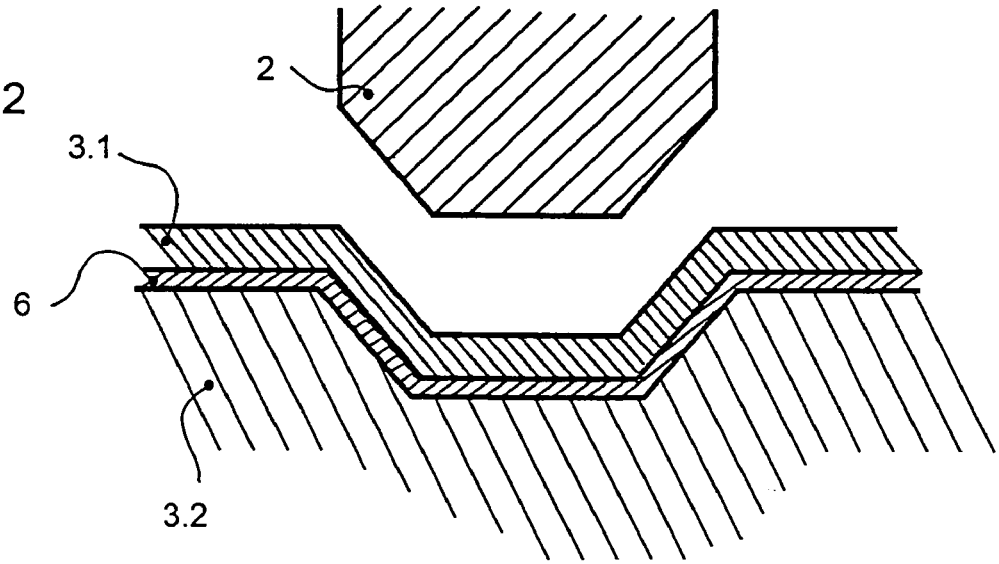
FIG. 2 a forming device with punch, mold, tool template and intermediate layer.

According to FIG. 2 the mold 3 is comprised of a first part 3.1 and a second part 3.2. The second part 3.2 is a base body, and the first part 3.1 is a base body 3.2 covering tool template. The tool template thereby exhibits a thickness of between 0.5 mm and 4 mm, preferably between 1 mm and 2 mm. Between the tool template 3.1 and the base body 3.2 there is provided an intermediate layer 6. The intermediate layer 6 is an elastic layer with a smaller modulus of elasticity (E-modulus) than the base body 3.2. It is also possible to form this intermediate layer 6 as a measuring strip or sheet, in order to measure the various shaping forces on the surface 3.3 or, as the case may be, on the (conical) joint surface between the mold 3 and the punch 2.

REFERENCE NUMBER LIST

1 Molding device
2 Punch
3 Mold
3.1 First part, tool template
3.2 Second part, base body
3.3 Surface
4 Pressure space, actuator, hydraulic pocket
5 Pressure measuring means
5' Pressure measuring means
6 Intermediate layer

The invention claimed is:

1. A compression molding device (1) for shaping a work piece, comprising:

a mold (3) having a work piece associated surface area for generating at least a part of the work piece geometry, a punch (2) having a work piece associated surface area corresponding to at least a part of the work piece geometry, wherein at least one of the mold (3) and the punch (2) include a pressure measuring means (5) below the surface for measuring a localized pressure in the area of the work piece associated surface (3.3) area, and wherein at least one of the mold (3) and the punch (2) has embedded in the mold at least one actuator (4) below the work piece associated surface area (3.3).

2. A device according to claim 1, wherein the pressure measuring means (5) and/or the actuator (4) are hydraulic pocket(s) or pressure space(s) oriented relative to the surface (3.3), and the distance between the pressure space (4) and the surface (3.3) lies between 0.5 mm and 3 mm.

3. A device according to claim 2, wherein the distance between the pressure space (4) and the surface (3.3) is approximately 1 mm.

4. A device according to claim 1, wherein the pressure measuring means (5) is a piezo-sensor and/or a measuring strip provided at the level of the surface (3.3) or directly below the surface (3.3).

5. A device according to claim 1, wherein multiple pressure measuring means (5, 5') and/or pressure spaces (4) are provided oriented relative to the surface (3.3).

6. A compression molding device for shaping a work piece, comprising at least one mold (3) with a work piece associated surface area for generating at least a part of the geometry of the work piece, a punch (2) with a work piece associated surface area for generating at least a part of the geometry of the work piece, wherein at least one of the mold (3) and the punch (2) are comprised of at least first and second parts, the first part (3.1) being a mold template forming the shape of the work piece and the second part (3.2) being the mold template receiving base body, wherein an intermediate layer (6) is provided between the mold template (3.1) and the base body (3.2), wherein said intermediate layer (6) is a measuring strip with at least one sensor and/or an elastic intermediate layer.

7. A device according to claim 6, wherein the mold template (3.1) is releaseably connected with the base body (3.2) and/or with the intermediate layer (6) and selectively provided on the intermediate layer (6) or on the base body (3.2).

8. A device according to claim 6, wherein the sensor is a dye or colorimeter sensor and/or a piezo element.

9. A device according to claim 8, wherein the base body (3.2) has a greater modulus of elasticity than the elastic intermediate layer (6).

10. A device according to claim 6, wherein the intermediate layer (6) is plastic and the mold template (3.1) is comprised of a wear or abrasion resistant material.

11. A compression molding device (1) for shaping a work piece, comprising:

a mold (3) having a work piece associated surface area for generating at least a part of the work piece geometry, a punch (2) having a work piece associated surface area corresponding to at least a part of the work piece geometry, wherein at least one of the mold (3) and the punch (2) optionally include a pressure measuring means (5) below the surface for measuring a localized pressure in the area of the work piece associated surface (3.3) area, and wherein at least one of the mold (3) and the punch (2) has embedded in the mold at least one actuator (4) below the work piece associated surface area (3.3).

* * * * *